US008167414B1

(12) United States Patent
Uptergrove

(10) Patent No.: US 8,167,414 B1
(45) Date of Patent: May 1, 2012

(54) PRINTING APPARATUS, SYSTEM AND METHOD

(75) Inventor: Ronald L. Uptergrove, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 258 days.

(21) Appl. No.: 12/486,264

(22) Filed: Jun. 17, 2009

Related U.S. Application Data

(60) Provisional application No. 61/073,403, filed on Jun. 18, 2008.

(51) Int. Cl.
*B41J 2/175* (2006.01)

(52) U.S. Cl. ..... 347/85

(58) Field of Classification Search ..... 347/5, 7, 347/37, 85
See application file for complete search history.

(56) References Cited

U.S. PATENT DOCUMENTS

| | | | | |
|---|---|---|---|---|
| 3,417,175 | A | 12/1968 | Brown et al. | |
| 3,490,363 | A | 1/1970 | Derrickson | |
| 3,999,190 | A | 12/1976 | Brown et al. | |
| 4,519,310 | A | 5/1985 | Shimizu et al. | |
| 5,011,862 | A | 4/1991 | Melber et al. | |
| 5,182,571 | A | 1/1993 | Creagh et al. | |
| 5,753,325 | A | 5/1998 | McDaniel et al. | |
| 5,858,514 | A | 1/1999 | Bowers | |
| 5,969,735 | A * | 10/1999 | Haigo | 347/85 |
| 5,984,456 | A | 11/1999 | Bern | |
| 6,002,844 | A | 12/1999 | Kishida et al. | |
| 6,082,563 | A | 7/2000 | Kohn et al. | |
| 6,135,654 | A | 10/2000 | Jennel | |
| 6,220,700 | B1 * | 4/2001 | Haigo | 347/85 |
| 6,406,115 | B2 | 6/2002 | Mantell et al. | |
| 6,409,294 | B1 | 6/2002 | Zimmermann et al. | |
| 6,460,991 | B1 | 10/2002 | Temple et al. | |
| 6,513,435 | B2 | 2/2003 | Detzner | |
| 6,682,191 | B2 | 1/2004 | Temple et al. | |
| 6,706,342 | B2 | 3/2004 | Kong et al. | |
| 6,769,357 | B1 | 8/2004 | Finan | |
| 7,004,557 | B2 * | 2/2006 | Inoue | 347/19 |
| 7,128,406 | B2 | 10/2006 | Dixon et al. | |
| 7,182,418 | B2 | 2/2007 | Harvey et al. | |
| 7,628,476 | B2 * | 12/2009 | Matsuba et al. | 347/85 |
| 2002/0097280 | A1 | 7/2002 | Loper et al. | |
| 2005/0211371 | A1 | 9/2005 | Hirst et al. | |
| 2006/0250464 | A1 | 11/2006 | Sheinman | |
| 2009/0160901 | A1 | 6/2009 | Achhammer | |

FOREIGN PATENT DOCUMENTS

| | | | |
|---|---|---|---|
| WO | WO 03/002349 | A2 | 1/2003 |

* cited by examiner

*Primary Examiner* — Anh T. N. Vo
(74) *Attorney, Agent, or Firm* — Dykema Cossett PLLC

(57) ABSTRACT

A printing apparatus and system for printing is disclosed. The print apparatus includes a print head, an ink reservoir, and at least one conduit for supplying ink from the ink reservoir to the print head. In an embodiment, the ink reservoir is operatively connected to the print head such that the vertical movement of the ink reservoir substantially coincides with a similar vertical movement of the print head.

20 Claims, 5 Drawing Sheets

PRINTING APPARATUS, SYSTEM AND METHOD

RELATED APPLICATION

This application claims the benefit of the filing date of provisional application Ser. No. 61/073,403, titled PRINTING APPARATUS, SYSTEM AND METHOD, filed Jun. 18, 2008, which is incorporated by reference in its entirety as if fully set forth herein.

TECHNICAL FIELD

The present invention relates to ink printing apparatus, systems and methods, including digital ink printing apparatus, systems and methods useful for printing on various articles, including plastic containers.

BACKGROUND

Printing systems having various forms of print heads, such as inkjet print heads, are found in the art. Further, systems for printing on articles, such as plastic containers, are also known. For instance, an example of a system and method for printing digital images on plastic containers is disclosed in U.S. Pat. No. 7,210,408 to Uptergrove.

SUMMARY

A printing apparatus is disclosed. The printing apparatus includes a print head, an ink reservoir, and a conduit. The print head includes at least one opening for dispensing ink, and the conduit supplies ink from the ink reservoir to the print head. In an embodiment, the ink reservoir is operatively connected to the print head such that the vertical movement of the ink reservoir substantially coincides with a similar vertical movement of the print head. Embodiments of a related system and method are also described.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
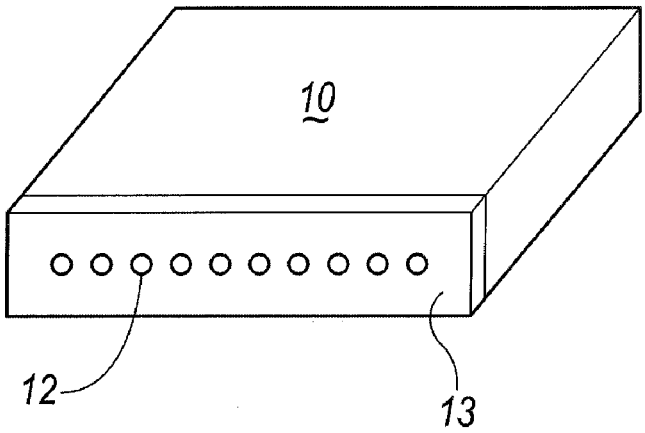
FIG. 1 is a perspective view of a generic print head.

FIG. 1 generally illustrates a perspective view of a generic print head 10. The print head 10 may include one or more openings 12 for discharging an ink or other print medium. Openings 12 may comprise tiny holes or jetting nozzles and, if desired, may be provided in a nozzle plate 13. It is noted, however, that the invention is not limited to a specific form of print head and the term "print head" as used herein is meant to generally encompass a wide variety of ink dispersion devices as would be known to those in the art.

Figure 2:
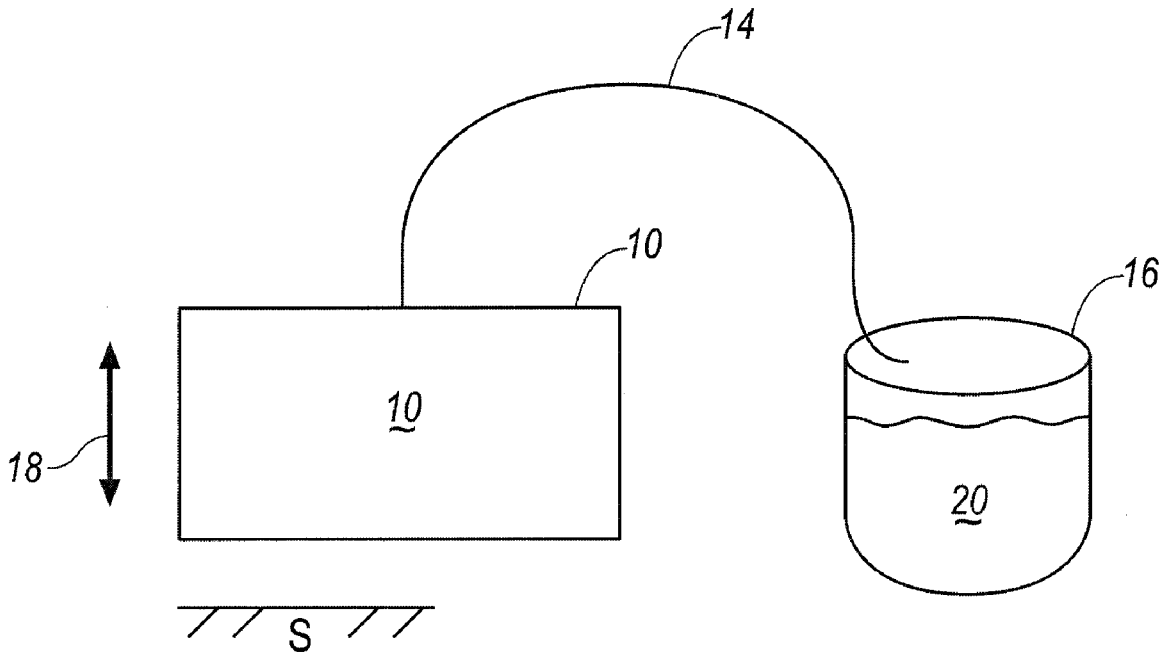
FIG. 2 is a schematic representation of a conventional configuration for a movable print head.

FIG. 2 is a generic representation of various conventional ink printing systems. As generally illustrated, a print head 10 is connected, for example by one or more conduits 14, to an ink well or reservoir 16, which is typically provided off to the side of the print head 10. The conduit 14 may be flexible and can comprise a hose, tube, supply line, or other conventional means for supplying ink from an ink well to a print head. The ink reservoir 16 feeds or provides ink or various other printing mediums (hereinafter collectively referred to as "ink") to a print head. The included arrow 18 generally represents the movement of the associated print head 10 in an up-down direction (e.g., relative to the surface S to be printed).

Figure 3:
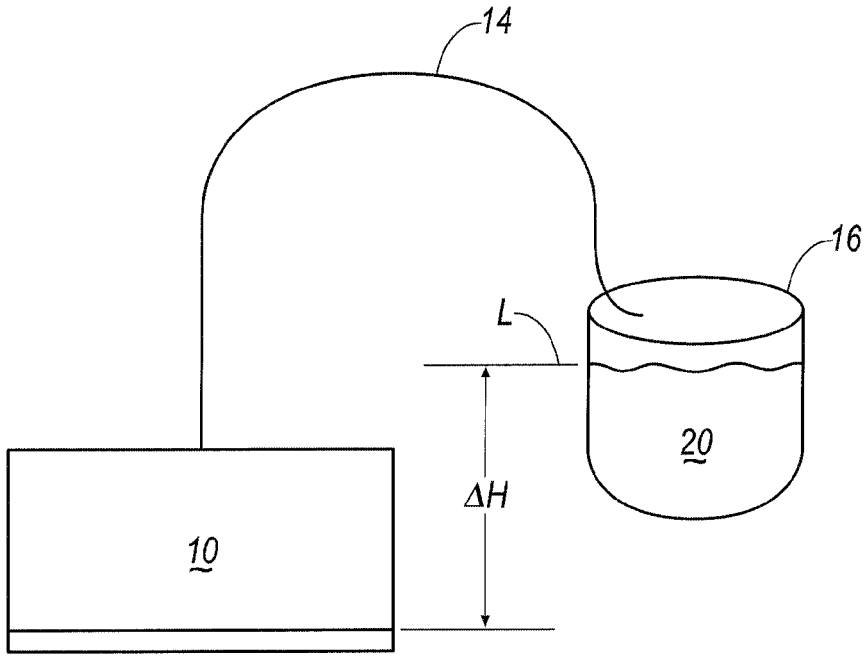
FIGS. 3 and 4 are schematic illustrations showing variations in the respective height of the print head with respect to the associated ink reservoir.
Figure 4:
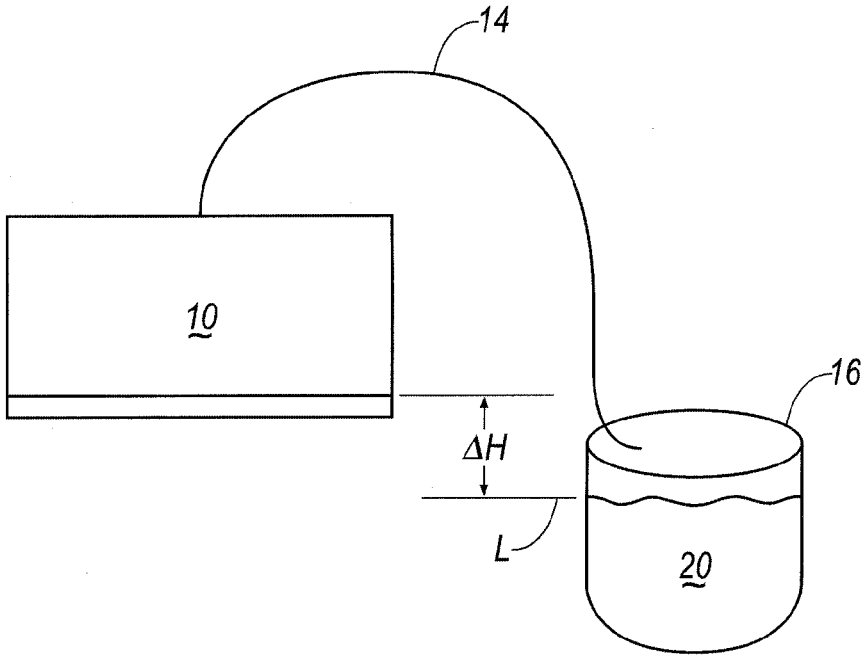

FIGS. 3 and 4 graphically represent a movable print head 10 shown at two different positions, or heights, relative to a respective ink reservoir 16 that is substantially stationary. As generally shown, as the print head 10 is moved (e.g., down/up) with respect to the ink reservoir 16, the level L of ink 20 will be at a different height with respect to ink (e.g., provided at the point of exit) in the print head 10. Consequently, as the print head 10 is moved up-down with respect to the ink reservoir 16 there will be a corresponding change in pressure, based on the difference in height based on the relative differences in heights (vertical position) between the print head 10 and reservoir 16. That is the "head," or difference in elevation between two points in a column of fluid change, and there is a resulting pressure difference associated with the fluid (i.e., ink) at the lower point.

Figure 5:
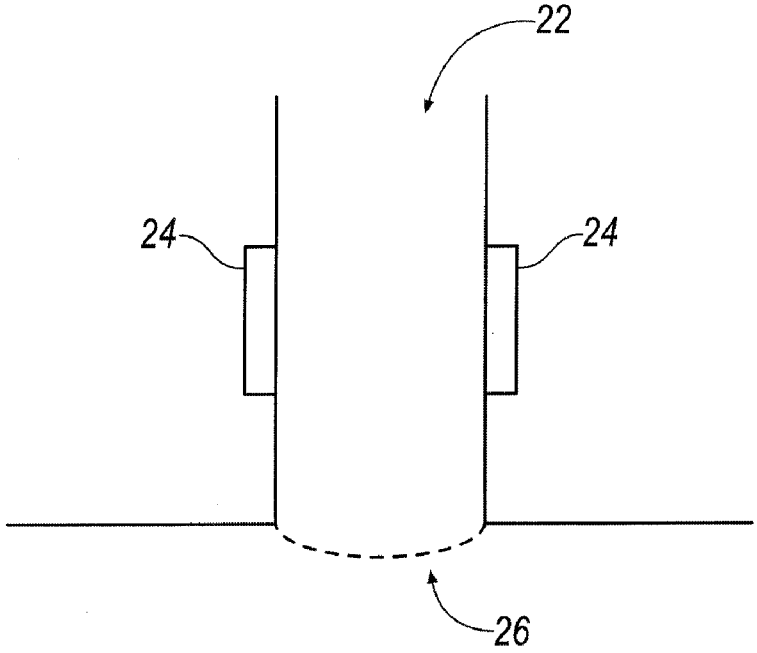
FIG. 5 generally illustrates a generic print head exhibiting a convex meniscus.
Figure 6:
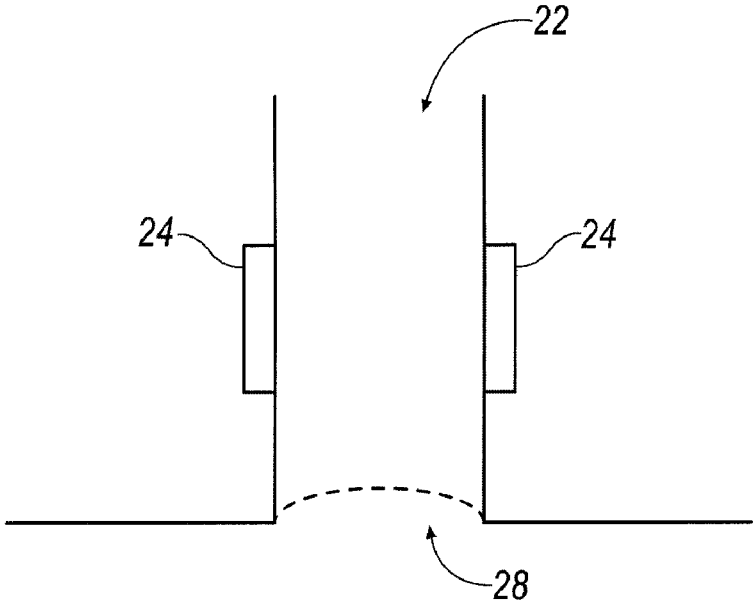
FIG. 6 generally illustrates a generic print head exhibiting a concave meniscus.

FIGS. 5 and 6 illustrate generic examples of exit chambers 22 of a print head shown in a constant pressure equilibrium state of fluid at the orifice without any drop formation excitation. FIG. 5 generally illustrates a convex meniscus 26, while FIG. 6 illustrates a concave meniscus 28. As further shown, the chambers may include a means for deforming a portion of the chamber 22 and causing a pressure wave in the chamber upstream from an exit orifice. In the illustrated embodiments, the means for deforming comprises a plurality of piezo crystals 24 that may be controlled, e.g., energized, to cause a pressure wave in the chamber and force an amount of fluid (e.g., ink) to be ejected from the chamber. With such a configuration, the waveform applied to a piezo-electric actuator (not shown) can energize the piezo crystals 24 to cause vibrational energy creating a positive pressure wave in the chamber 22 that disrupts the illustrated equilibrium providing a pressure that, under the right conditions, discharges ink.

Figure 7:
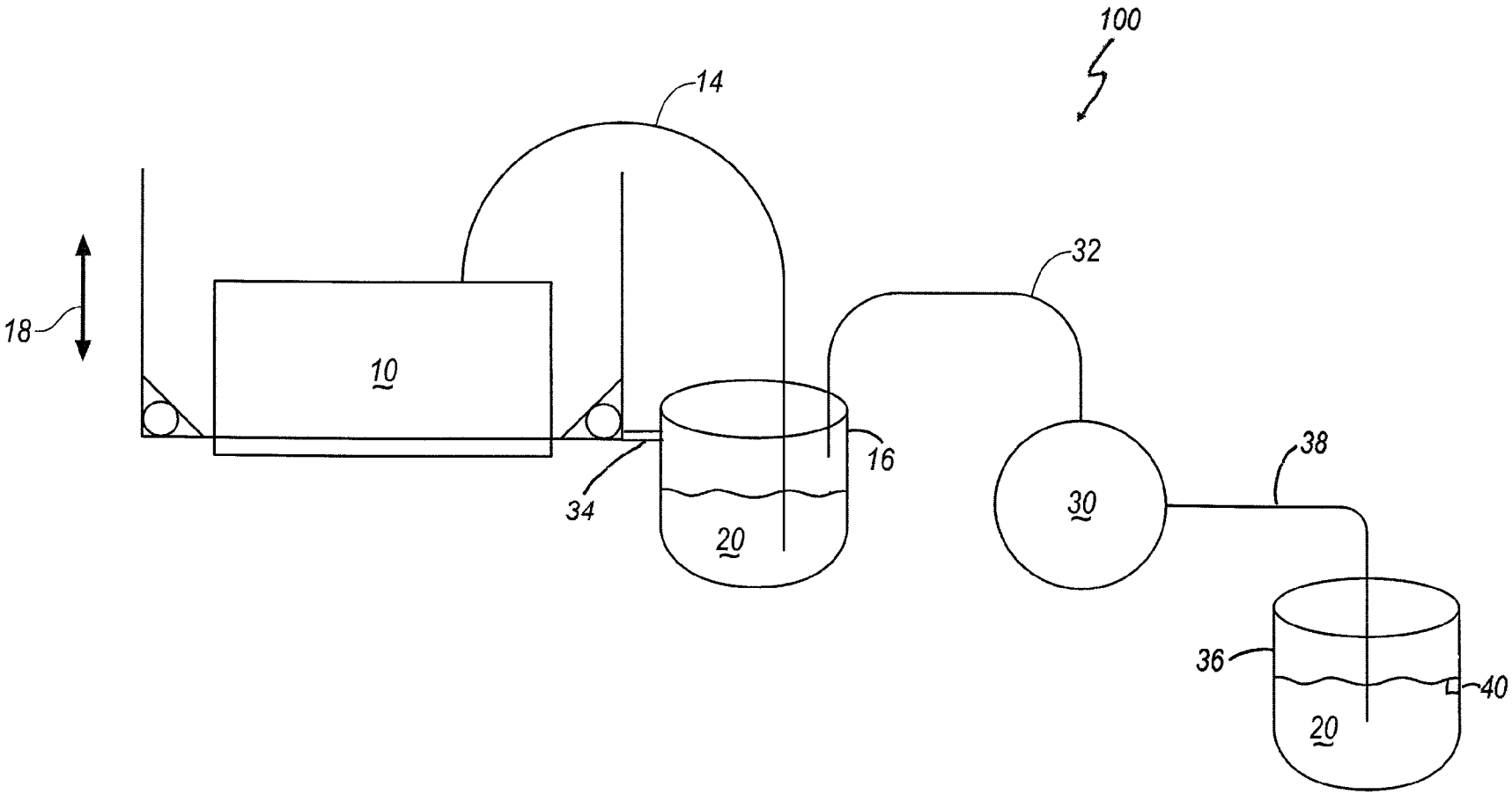
FIG. 7 generally illustrates a configuration of a printing apparatus in accordance with an embodiment of the invention.

FIG. 7 generally illustrates an embodiment of an apparatus embodying teachings of the present invention in the context of a printing system 100. The illustrated system 100 includes a print head 10 and an ink reservoir 16 that are connected by at least one conduit 14. The system shown further includes a pump 30 or other means for supplying additional fluid to the reservoir 16 via at least a second conduit 32. In the instant embodiment, the reservoir 16 is connected to the print head 10, or component rigidly attached to the print head 10, so that the up-down (vertical) movement of the reservoir 16 will substantially coincide with the up-down (vertical) movement of the print head 10. For example, without limitation, the reservoir 16 may be connected or mounted on or to a print bar or extension (generically shown as element 34 in FIG. 7) associated with or connected to the print head 10. With such an operable connected configuration, the change in height or elevation between the ink reservoir and the ink in the print head can remain constant, or at least substantially constant, and will not significantly change with the movement, i.e., the up-down (vertical) movement, of the print head 10. While a simple bar or extension 34 is illustrated, various other structural configurations and forms of connection or attachment may be utilized. By way of example, without limitation, the print head 10 and reservoir 16 may share a common extension or platform.

The "on-board" ink reservoir 16 can be fed additional fluid (i.e., ink) from an associated pump 30 or other means for feeding additional fluid to the reservoir. Further, as generally illustrated, the pump 30 may be supplied ink 20 from a pump-supplying reservoir 36 via at least one pump-supplying conduit 38. The system may further include one or more level control sensors (generically shown as 40) that sense the level of fluid within components of the system and provide information or feedback for the control of fluid from the pump 30 to the reservoir 16 in accordance with some select or prescribed parameters.

For some embodiments of the invention, it may be beneficial that the conduit 14 supplying ink from the reservoir 16 to the print head 10 be minimized to reduce the associated mass, which in turn can reduce the associated forces in the head and changes in associated dynamics. That is, for some embodiments, it may be beneficial to provide a relatively short, small-diameter conduit to help reduce the hydraulic force applied as the print head accelerates up and down. By way of example, without limitation, the length of the conduit 14 may be less than 36 inches, and for some embodiments may be less than 12 inches, and the internal diameter of the conduit 14 may be less than 0.25 inches, and for some embodiments may be less than 0.0625 inches.

Figure 8:
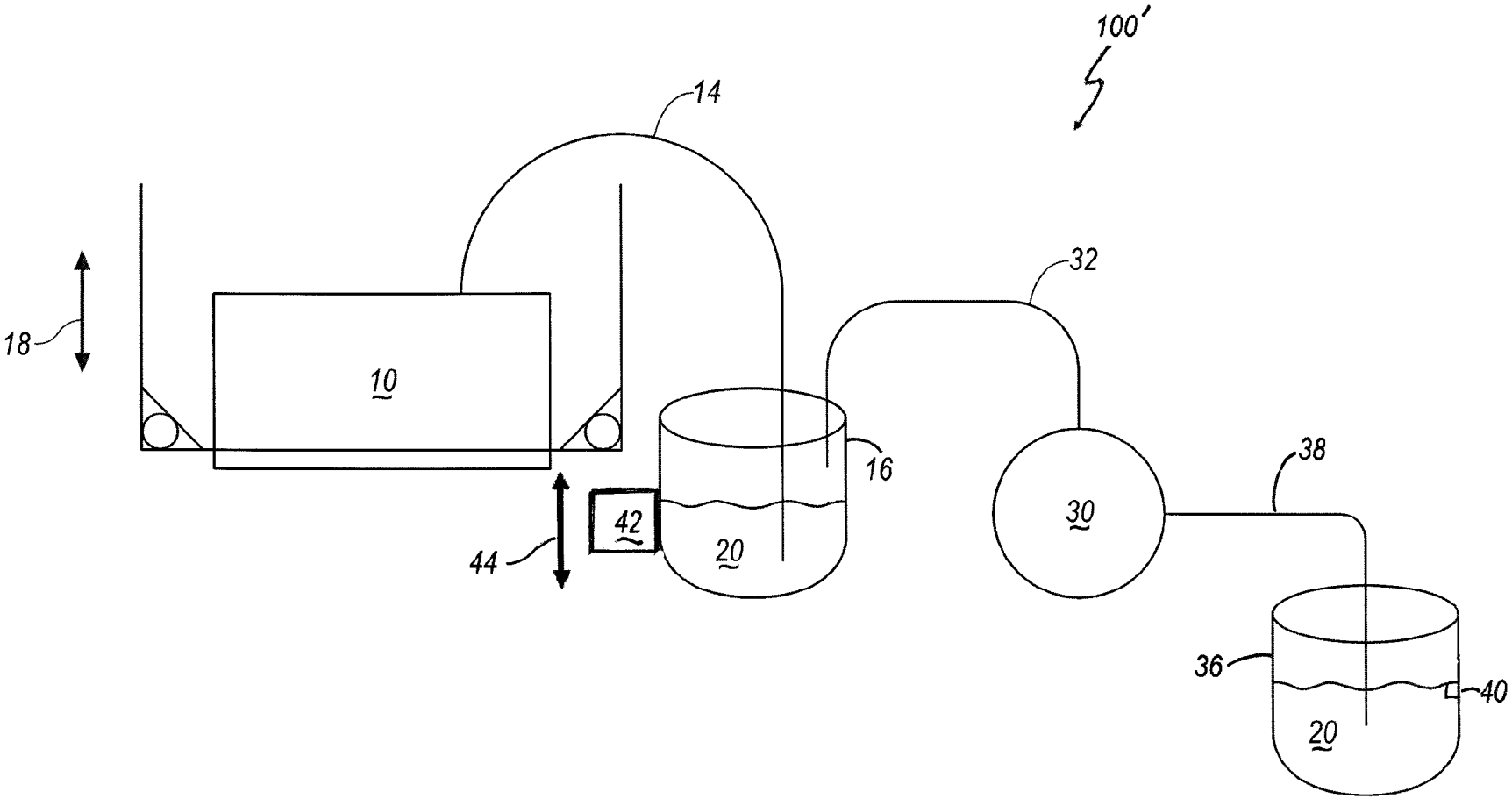
FIG. 8 generally illustrates a configuration of a printing apparatus in accordance with another embodiment of the invention.

FIG. 8 generally illustrates another embodiment of a system 100' embodying teachings of the present invention. System 100' illustrates similar components to those identified and described in connection with FIG. 7. However, in the alternate embodiment, the reservoir 16 may not be directly connected to the print head 10 such that the movement of the print head 10 directly moves the reservoir up-down (vertically). Rather, the up-down movement of the print head 10 may be measured or determined and a separate apparatus (generically identified as 42), which may be configured to receive a signal regarding the vertical movement or position of the print head 10, can provide a corresponding up-down movement (see, e.g., included arrow 44) to the reservoir 16 such that the relative elevations between the reservoir 16 and the print head 10 remain substantially constant. It is noted that for some other embodiments, the aforementioned corresponding movement could be reversed. That is, the vertical movement of the apparatus 42 could be measured or determined and the print head 10 could be moved so that the relative elevations remain substantially constant.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed is:

1. A printing apparatus comprising:

a print head including at least one opening for dispensing ink;

an ink reservoir; and a conduit for supplying ink from the ink reservoir to the print head;

wherein the ink reservoir is rigidly connected to the print head by a bar or extension such that the vertical movement of the ink reservoir directly mechanically coincides with the vertical movement of the print head.

2. The printing apparatus of claim 1, wherein the print head includes a nozzle plate.

3. The printing apparatus of claim 1, wherein the ink reservoir is positioned to the side of the print head.

4. The printing apparatus of claim 1, wherein the conduit is flexible and comprises a hose, a tube, or a supply line.

5. The printing apparatus of claim 1, wherein the print head is configured to move in a vertical up-down direction relative to a surface to be printed.

6. The printing apparatus of claim 1, including a pump for supplying additional ink to the ink reservoir.

7. The printing apparatus of claim 6, including a second conduit extending between the pump and the ink reservoir.

8. The printing apparatus of claim 1, wherein the print head is rigidly connected or attached to the ink reservoir.

9. The printing apparatus of claim 1, wherein the ink reservoir is mounted on a print bar or extension connected to the print head.

10. The printing apparatus of claim 1, including a control sensor for sensing the level of fluid within the print head or the ink reservoir.

11. The printing apparatus of claim 1, including one or more sensors for sensing the level of fluid in the print head and the ink reservoir.

12. The printing apparatus of claim 1, including a pump for supplying additional ink to the ink reservoir, a second conduit extending between the pump and the ink reservoir, and one or more control sensors providing information or feedback to control the pump based on select or prescribed sensed parameters.

13. The printing apparatus of claim 12, including a pump-supplying reservoir and a pump-supplying conduit that extends between the pump and the pump-supplying reservoir.

14. The printing apparatus of claim 1, wherein the length of the conduit for supplying ink from the ink reservoir to the print head is less than about 36 inches.

15. The printing apparatus of claim 1, wherein the length of the conduit for supplying ink from the ink reservoir to the print head is less than about 12 inches.

16. The printing apparatus of claim 1, wherein the diameter of the conduit for supplying ink from the ink reservoir to the print head is less than about 0.25 inches.

17. The printing apparatus of claim 1, wherein the diameter of the conduit for supplying ink from the ink reservoir to the print head is less than about 0.0625 inches.

18. A printing apparatus comprising:

a print head including at least one opening for dispensing ink;

an ink reservoir;

a common rigid extension or platform configured to simultaneously move the print head and the ink reservoir in at least a vertical direction;

a conduit for supplying ink from the ink reservoir to the print head; and an ink supply and a pump for supplying additional ink to the ink reservoir from the ink supply;

wherein the apparatus is configured so that the vertical movement of the ink reservoir directly corresponds or coincides with the vertical movement of the print head.

19. The printing apparatus of claim 18, including one or more control sensors providing information or feedback control to the pump based on select or prescribed sensed parameters.

20. The printing apparatus of claim 19, wherein the one or more control sensors include a fluid level sensor.

* * * * *